US007191586B2

(12) United States Patent
Yamamoto

(10) Patent No.: US 7,191,586 B2
(45) Date of Patent: Mar. 20, 2007

(54) CONNECTOR, BAND AND WATCH

(75) Inventor: Akio Yamamoto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 326 days.

(21) Appl. No.: 10/902,282

(22) Filed: Jul. 30, 2004

(65) Prior Publication Data

US 2005/0060981 A1 Mar. 24, 2005

(30) Foreign Application Priority Data

Jul. 31, 2003 (JP) ..... 2003-204702

(51) Int. Cl.
*F16G 15/04* (2006.01)

(52) U.S. Cl. ..... 59/82; 59/80; 59/85; 63/4

(58) Field of Classification Search ..... 59/80, 59/82, 85; 63/4, 7

See application file for complete search history.

(56) References Cited

U.S. PATENT DOCUMENTS

| | | | | |
|---|---|---|---|---|
| 4,269,026 | A * | 5/1981 | Bulle et al. | 59/82 |
| 4,781,035 | A * | 11/1988 | Gagnebin et al. | 59/82 |
| 5,197,274 | A * | 3/1993 | Braun | 59/80 |
| 6,098,394 | A * | 8/2000 | Hashimoto et al. | 59/82 |

FOREIGN PATENT DOCUMENTS

| | | | |
|---|---|---|---|
| JP | 4950654 | U | 8/1972 |
| JP | 52105662 | U | 2/1976 |
| JP | 62145510 | U | 9/1987 |
| JP | 1080303 | A | 3/1998 |
| JP | 200338218 | A | 2/2003 |
| JP | 2003116604 | A | 4/2003 |

OTHER PUBLICATIONS

Well-Known And Common-In-Use Arts (Steel Watchband), Dec. 25, 1981, Japan Patent Office, Japan.

* cited by examiner

*Primary Examiner*—David B. Jones
(74) *Attorney, Agent, or Firm*—Global IP Counselors, LLP

(57) ABSTRACT

The band relating to the present invention includes a first block, a second block, and a connector. The first connector has a concavity and first and second through-holes disposed on both sides of the concavity. The second block as a convexity that interlocks with the concavity and that has a third through-hole. The connector is inserted through the first, second, and third through-holes. The connector has a first linear part, a second linear part, and a folded portion that connects the first and second linear parts. The first linear part has a first rectilinear part extending from the folded portion and separated from the second linear part in a free state, a first protrusion extending from the first rectilinear part and protruding away from the second linear part, and a first end extending from the proximal end of the first protrusion away from the folded portion. The first end has a first tip disposed such that the distance thereof to the second linear part is shorter than the distance to the second linear part from the proximal end of the first protrusion in a free state.

24 Claims, 19 Drawing Sheets

CONNECTOR, BAND AND WATCH

FIELD OF THE INVENTION

The present invention relates to a connector for connecting adjacent members to each other, and a band and timepiece provided with this connector, and relates to, for example, a connector for connecting the block members in the band of a timepiece, and a band and timepiece provided with this connector.

DESCRIPTION OF THE RELATED ART

One example of a method for connecting a plurality of blocks to each other in a band or the like of a timepiece involves forming through-holes in the ends of the blocks, and inserting a common connector through these through-holes (for example, Japanese Patent Application Laid-Open No. 10-80307, pp. 7–8, FIG. 2). This connector is made of a cross-sectional turtleback-shaped metal wire folded in two. A part of the metal wire is bent to form an outward protrusion. A large-diameter region that is larger than the inner periphery of the through-holes is formed in the through-holes of the blocks, and when the connector is inserted via the through-hole, the protrusion is caused to engage the large-diameter region. The connector can therefore be reliably fixed in the through-hole.

However, when the connector is inserted via the through-hole, the protrusion is pressed by the inner periphery of a through-hole with a smaller diameter until it reaches the large-diameter region, and sometimes the protrusion is elastically deformed. Such a case has problems in that when the connector is repeatedly inserted and removed in the through-hole to adjust the band length, the dimensions of the protrusion change due to the elastic deformation. Thus, the force by which the connector is fixed in the inner periphery of the through-hole is reduced. When such a connector is used, there is the possibility that the connector will fall out during use due to the reduction in the fixing force.

SUMMARY OF THE INVENTION

An object of the present invention is to provide a connector whereby a stable fixing force can be obtained even with repeated use, and to provide a band that has this connector.

A band includes a first block, second block, and connector. The first block has a concavity and first and second through-holes disposed on either side of the concavity. The second block has a convexity that interlocks with the concavity and has a third through-hole. The connector is inserted through the first, second, and third through-holes. The connector has a first linear part, a second linear part, and a folded portion. The first linear part has a first rectilinear part extending from the folded portion, a first protrusion that extends from the first rectilinear part, and an end that extends from the proximal end of the first protrusion away from the folded portion. The end has a tip disposed such that the distance thereof to the second linear part is shorter than the distance to the second linear part from the proximal end of the first protrusion in a free state.

The second block may have a large-diameter portion with which the first protrusion is engaged, disposed between the second through-hole and the third through-hole. The large-diameter portion may have an inside diameter that is larger than the total thickness of the connector in the first protrusion in a free state. The large-diameter portion may also have an inside diameter that is larger than the total thickness of the connector in the first and second protrusions in a free state.

The second linear part may have a second rectilinear part extending from the folded portion and separated from the first linear part in a free state, a second protrusion extending from the second rectilinear part and protruding away from the first linear part, and a second end extending from the proximal end of the second protrusion away from the folded portion. The second end may have a second tip disposed such that the distance thereof to the first linear part is shorter than the distance to the first linear part from the proximal end of the second protrusion in a free state.

The objects, characteristics, merits, and other attributes of the present invention described above shall be clear to those skilled in the art from the description of the invention hereinbelow. The description of the invention and the accompanying diagrams disclose the preferred embodiments of the present invention.

DESCRIPTION OF THE PREFERRED EMBODIMENTS

Embodiments of the invention will now be described with reference to the drawings. In the second and subsequent embodiments hereinafter described, the same symbols are used to denote identical components or components that have the same functions as the structural components in the first embodiment described below, and descriptions thereof are simplified or omitted.

First Embodiment

Figure 1:
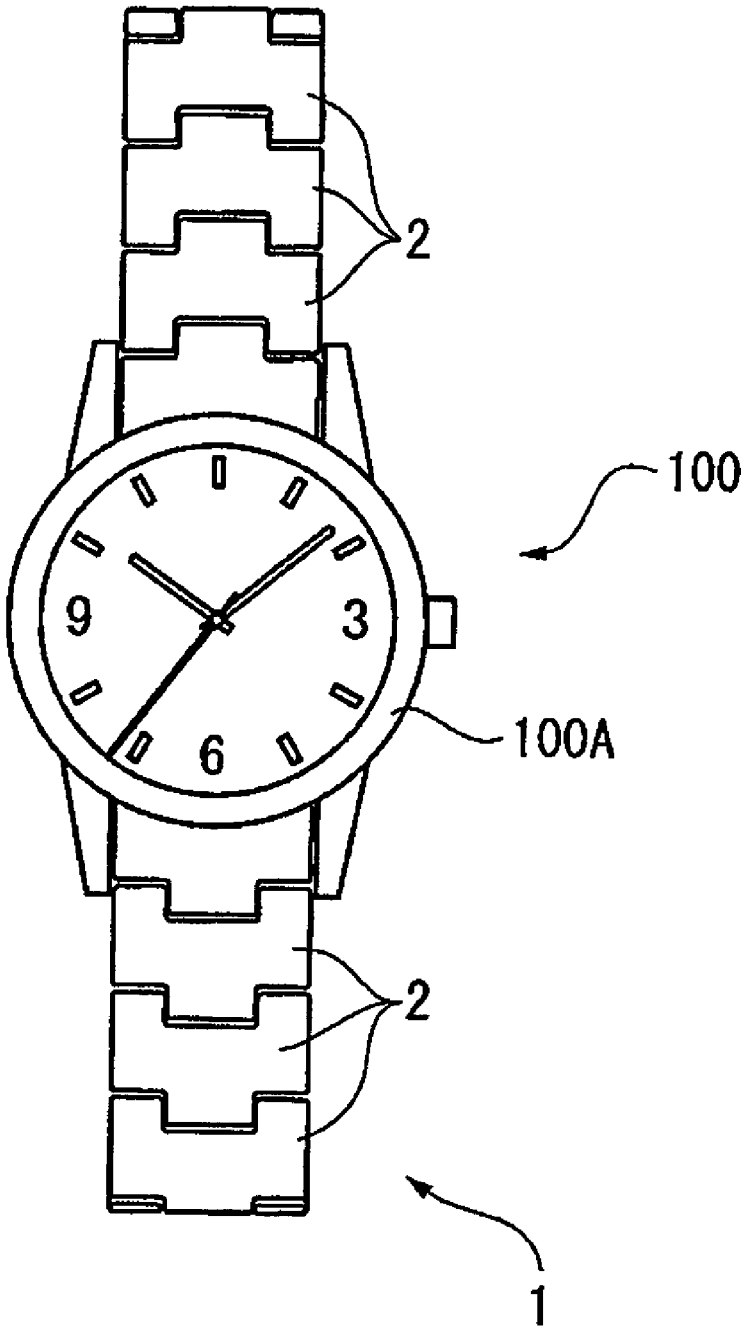
FIG. 1 is a diagram showing a timepiece according to the first embodiment of the present invention.
Figure 2:
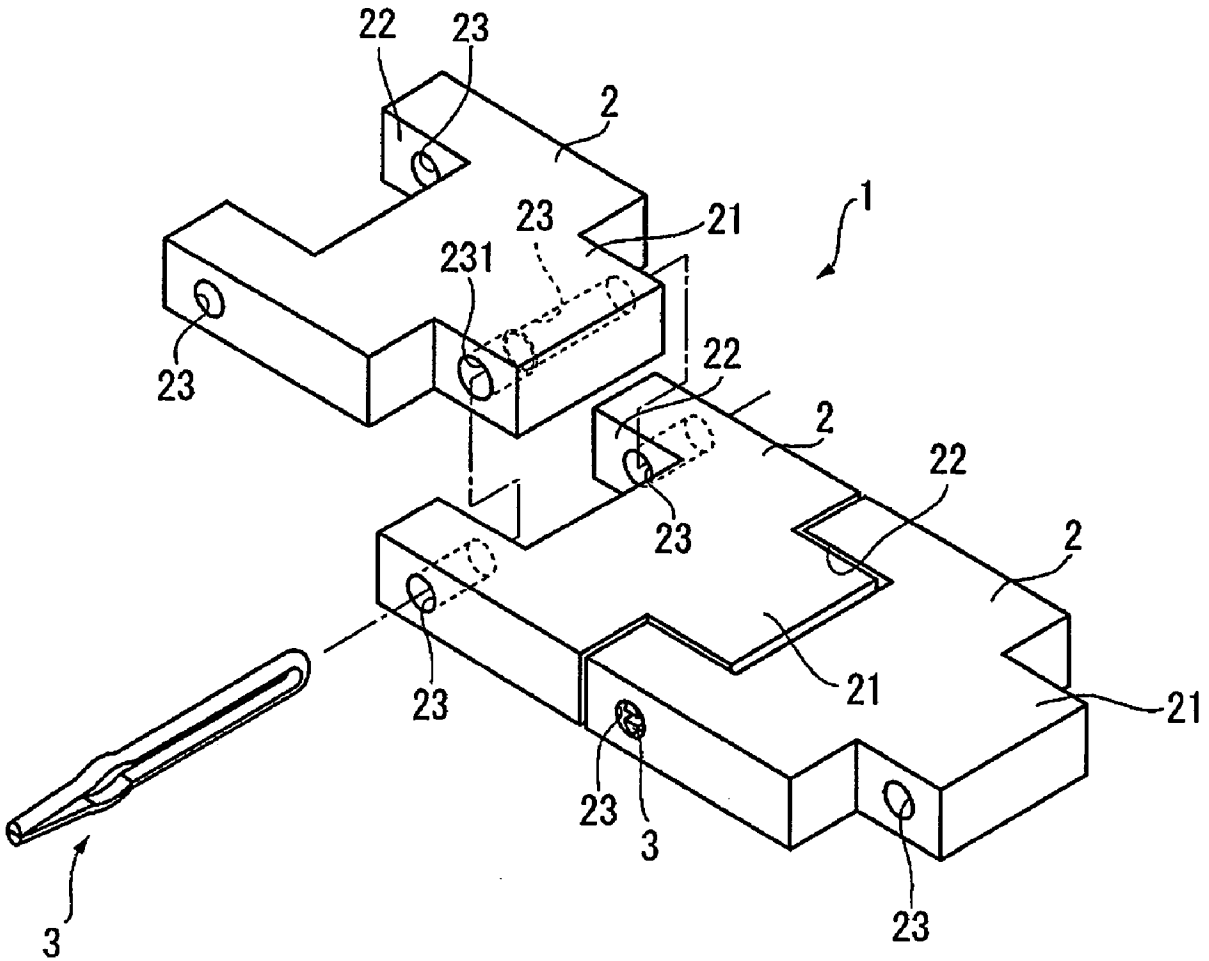
FIG. 2 is a perspective view showing a band of the timepiece.

FIG. 1 shows a timepiece 100 according to a first embodiment. FIG. 2 shows a perspective view of a band 1 of the timepiece 100. The band 1 is fitted to the timepiece main body 100A of the timepiece 100 in FIGS. 1 and 2, and is configured with a plurality of blocks (block members) 2 connected in belt form. The timepiece main body 100A is configured with a time display to display the time, a drive mechanism for driving the time display, and a mainspring or battery or another such power source to supply drive energy to the drive mechanism housed inside a metallic case formed from stainless steel, a titanium alloy, or the like. In the present embodiment, the timepiece 1 is a wristwatch showing the time in an analog display, but is not limited thereto and may be a wristwatch showing the time in a digital display.

The blocks 2 are formed into substantially rectangular plates, and convexities 21 are formed substantially in the middle lengthwise. Also, concavities 22 are formed substantially in the middle lengthwise on the opposite side of the convexities 21. Through-holes 23 running lengthwise are formed in the distal end side of the convexities 21 and in the protruding portions on both sides of the concavities 22. The through-holes 23 in the convexities 21 and the through-holes 23 in the concavities 22 are disposed in a line when the convexities 21 engage the adjacent concavities 22. Large-diameter portions 231 that are larger in diameter than the other portions are formed spanning a specific length in the ends of the through-holes 23 formed in the convexities 21.

These blocks 2 are connected to each other by inserting common connecting pins 3 through both through-holes 23 in a state in which the convexities 21 engage the concavities 22 in the adjacent blocks 2.

Figure 3:
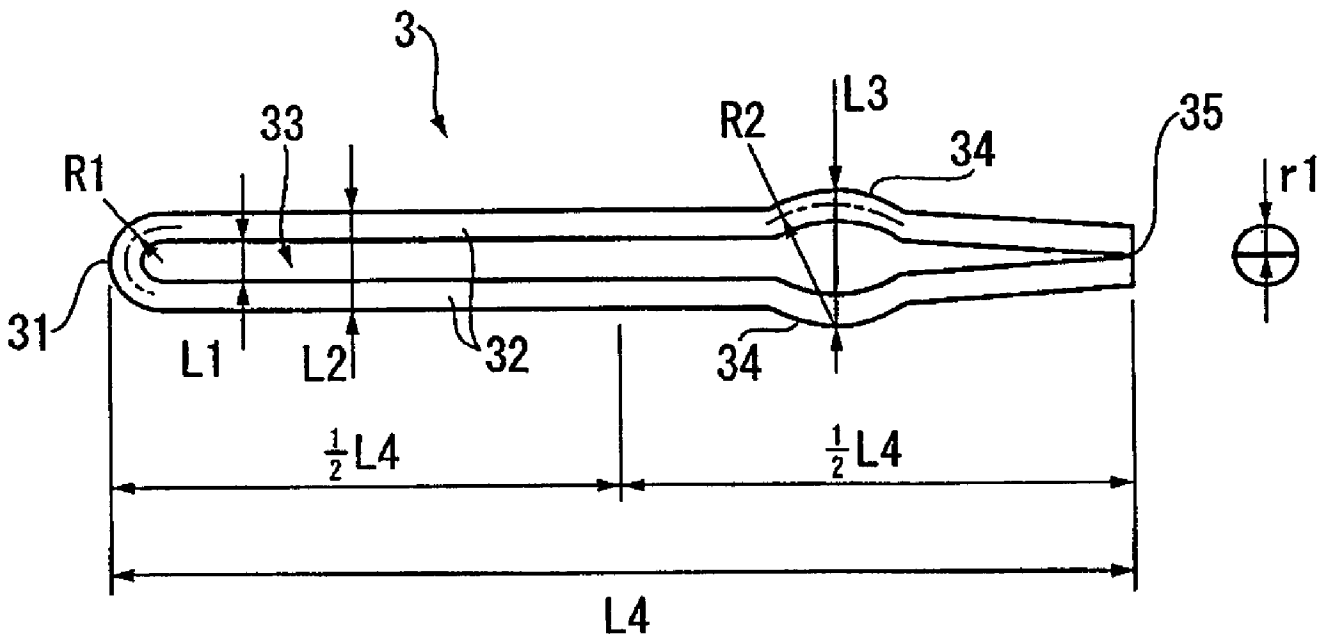
FIG. 3 is a side view showing the connector in the band.

FIG. 3 shows a side view of a connecting pin 3. The connecting pin 3 in FIG. 3 is configured from a linear metal member having substantially half-circle shape (turtleback shape) with a radius r1 in cross section, and is formed into a substantial U shape that includes a folded portion 31 folded substantially in the lengthwise center such that the portions that are rectilinear in cross section inwardly face each other, and also includes linear parts 32 with substantially rectilinear shapes disposed on either side of the folded portion 31. The folded portion 31 is folded into a substantial semicircle having a specific radius of curvature R1, whereby the proximal end sides of a pair of linear parts 32 (the sides near the folded portion 31) are disposed to be nearly parallel to each other. In other words, the proximal end sides of the pair of linear parts 32 are disposed with a specific distance L1 therebetween.

Protrusions 34 that engage the large-diameter portions 231 are formed at locations corresponding to the large-diameter portions 231 in the distal end sides of the linear parts 32 in a state in which the connecting pin 3 is inserted through the inner periphery of the through-hole 23 of the block 2. The protrusions 34 are formed by bending a part of each of the linear parts 32 in the middle, and protrude in an essentially arcuate shape with a radius of curvature R2 away from the linear parts 32.

The distal ends of the linear parts 32 come into contact with each other to form a contact section 35. This contact section 35 is formed by slanting the linear parts 32 nearer to the distal end side such that they draw nearer to each other than the proximal ends of the protrusions 34. The two linear parts 32 are thereby connected to each other at both sides, at the folded portion 31 on one side of the protrusions 34, and through the contact section 35 on the other side of the protrusions, and a space 33 is formed between these linear parts 32. As a result of this space 33, the connecting pin 3 can be deformed in the direction in which the two linear parts 32 draw near to each other.

In this case, the dimensions, shape, material, and the like of the connecting pin 3 are set such that each section thereof does not deform when the connecting pin 3 is mounted in the through-hole 23. Specifically, the cross-sectional dimension of the through-hole 23, in other words, the diameter D1 (see FIG. 5), is set to be equal to or greater than the distance L2 between the outer sides of the linear parts 32 when the connecting pin 3 is not deformed. Also, the cross-sectional dimension of the large-diameter portion 231, in other words, the diameter D2 (see FIG. 5) is set to be equal to or greater than the distance L3 in the direction in which the protrusions 34 protrude when the connecting pin 3 is not deformed.

Also, the protrusions 34 are formed nearer to the distal end side than the midpoint of the length L4 of the linear parts 32. Thus, as a result of forming the protrusions 34 on the distal end side of the linear parts 32, the length of the linear parts 32 from the folded portion 31 to the protrusions 34 is increased, and the linear parts 32 are more apt to bend when the connecting pin 3 is inserted via the through-hole 23.

Figure 4:
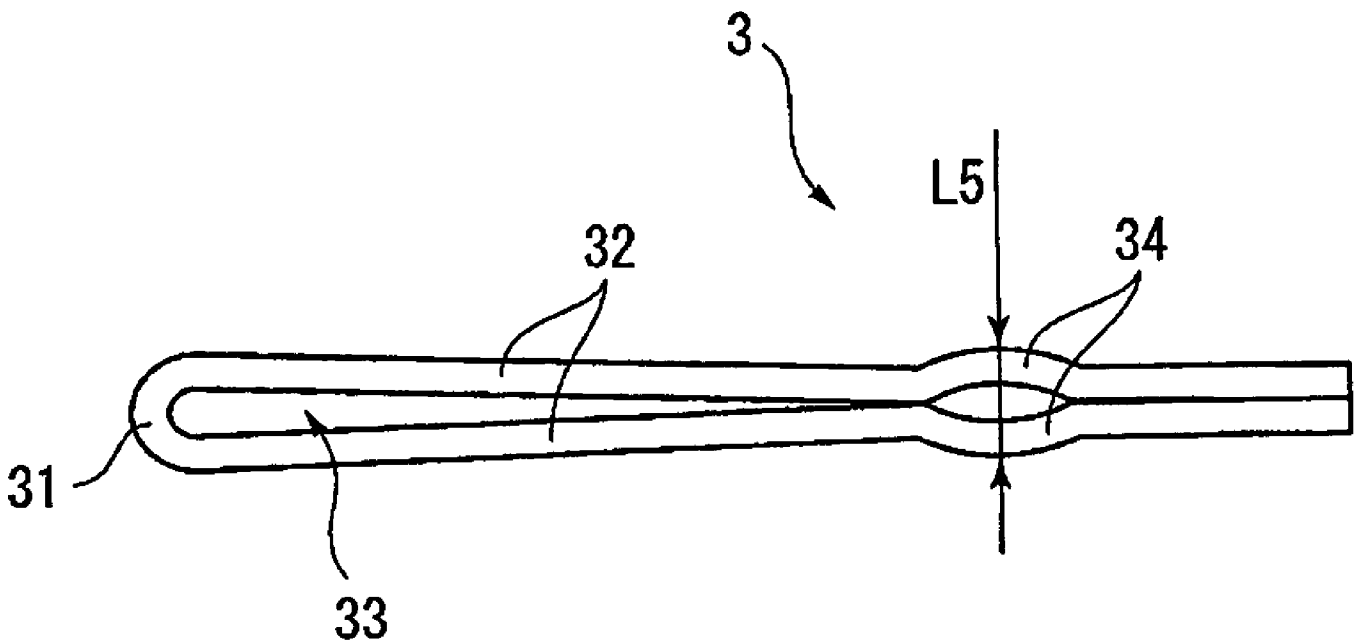
FIG. 4 is a diagram of when the connector is deformed.

FIG. 4 shows a diagram of the state of the connecting pin 3 when inserted via the through-hole 23. While the ends of the opposing protrusions 34 are in contact with each other in FIG. 4, the length L5 in the direction in which the protrusions 34 protrude is appropriately set in view of the pressing force setting needed for the connecting pin 3 or the like. The length may be set, for example, slightly larger than the diameter D1 of the through-hole 23 (for example, 2/100 mm).

Figure 5:
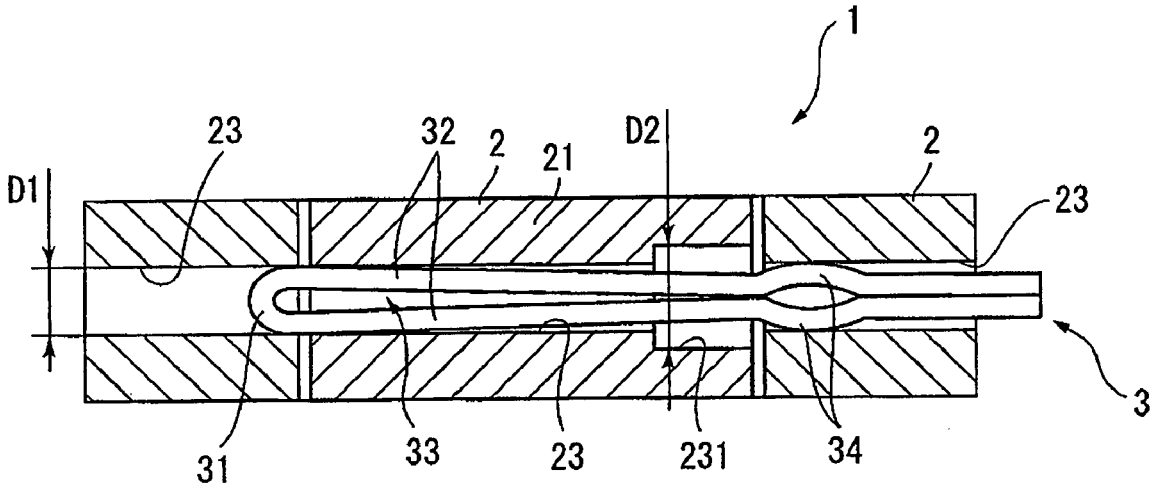
FIG. 5 is a diagram showing the connector in the process of being inserted via the through-hole.
Figure 6:
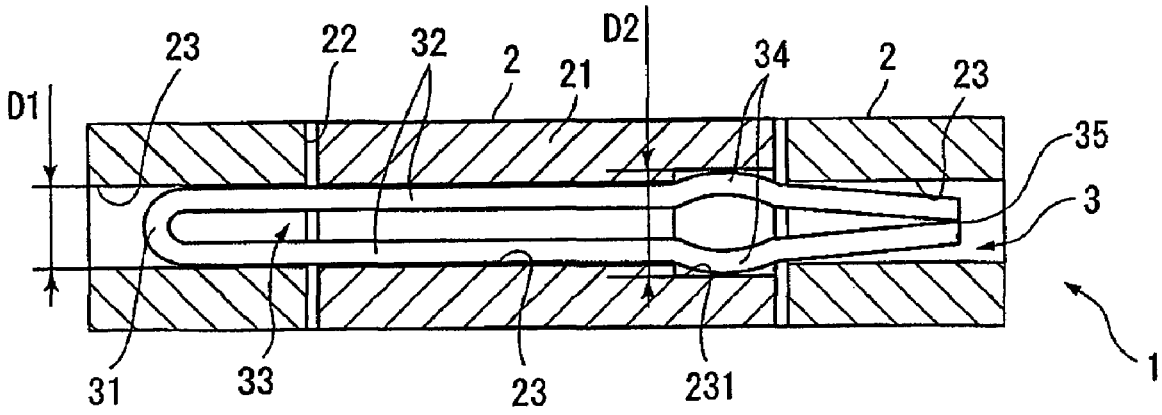
FIG. 6 is a diagram showing the connector having been inserted via the through-hole.

FIG. 5 is a diagram showing the state of the connecting pin 3 when inserted halfway via the through-hole 23. Also, FIG. 6 is a diagram of the state of the connecting pin 3 inserted all the way through the through-hole 23.

In FIG. 5, the convexities 21 of the blocks 2 are disposed in the adjacent concavities 22, and each through-hole 23 is disposed in a straight line. When the connecting pin 3 is inserted via the through-hole 23 by the folded portion 31, the protrusions 34 come into contact with the ends of the through-hole 23. Since the protrusions 34 are formed in an essentially arcuate shape, as the connecting pin 3 is inserted via the through-hole 23, the connecting pin 3 deforms until the linear parts 32, guided by the arcuate portions, draw near to each other while bending about the folded portion 31 and the contact section 35 as two points of support, and the ends of the protrusions 34 come into contact with each other. Then, if the length L5 is set larger than the diameter D1 of the through-hole 23, the protrusions 34 engage the inner periphery of the through-hole 23 as shown in FIG. 5 while the arcuate portions of the protrusions 34 slightly deform as such. The protrusions 34 are inserted by sliding in the axial direction while an appropriate urging force is maintained in the radially outward direction of the through-hole 23.

When the protrusions 34 of the connecting pin 3 are inserted up to a position corresponding with the large-diameter portion 231, the protrusions 34 are urged in the direction in which they separate from each other (the radially outward direction of the through-hole 23) by their own elasticity or the elasticity of the linear parts 32. The protrusions 34 are therefore caused by this urging force to protrude outward and engage the large-diameter portion 231 as shown in FIG. 6. In this state, since the distance L3 between the protrusions 34 is set to be equal to or less than the diameter D2 of the large-diameter portion 231 and the distance L2 between the linear parts 32 is set to be equal to or less than the diameter D1 of the through-hole 23, the connecting pin 3 does not deform inside the through-hole 23 and is mounted in the through-hole 23 in a free state.

Thus, the length of the band 1 can be adjusted by connecting an arbitrary number of adjacent blocks 2 with connecting pins 3.

When the connecting pin 3 is removed from the through-hole 23, the protrusions 34 and the large-diameter portion 231 can be disengaged by pushing on the folded portion 31 with a pin or another such suitable tool.

The following effects can be obtained with such a connecting pin 3.

(1) Since the pair of linear parts 32 are formed with a specific distance L1 therebetween and a space 33 is formed therein, a space wherein the linear parts 32 come close to each other can be maintained, so the connecting pin 3 can easily bend and deform. Therefore, the force needed to insert the connecting pin 3 via the through-hole 23 can be reduced. Since the force needed to insert the connecting pin 3 can be reduced, the connecting pin 3 can be easily pulled out and inserted, and the connecting pin 3 can be made easier to operate.

Also, since the linear parts 32 bend when the connecting pin 3 is inserted via the through-hole 23, the stress applied to the distal ends of the protrusions 34 can be reduced. It is therefore possible to suppress the elastic deformation of the distal ends of the protrusions 34 to a minimum, so the a stable force by which the connecting pin 3 is pulled out and inserted can be obtained even when the pin is pulled out and inserted repeatedly.

(2) Since the distal ends of the pair of linear parts 32 form a contact section 35 where they come into contact with each other, the connecting pin 3 deforms about the folded portion 31 and the contact section 35 as two points of support when inserted via the through-hole 23. Therefore, the stress at each point of support is reduced, so the connecting pin 3 deforms in a stable manner, repeated deformation due to pulling out and inserting the connecting pin 3 can be satisfactorily withstood, a stable fixing force is obtained, and the durability of the connecting pin 3 can be improved. Also, even when, for example, the length L4 of the linear parts 32 is large and the linear parts 32 have an easily bending shape, the flexural rigidity of the linear parts 32 can be improved as a result of the connecting pin 32 deforming about two points of support. Therefore, the fixing force needed for the connecting pin 3 can be easily maintained.

(3) Since the length L3 between the protrusions 34 is set to be equal to or less than the diameter D2 of the large-diameter portion 231, the connecting pin 3 is not pressed on by the inner periphery of the through-hole 23 and the inner periphery of the large-diameter portion 231 in a state in which the protrusions 34 engage the large-diameter portion 231. In other words, the cross-sectional dimension of the connecting pin 3 with the protrusions 34 is set to be equal to or less than the cross-sectional dimension of the through-hole 23 with the large-diameter portion 231. Therefore, the connecting pin 3 does not deform while inserted via the through-hole 23 and is in a state wherein stress resulting from external force does not occur, so creep deformation can be prevented and a satisfactory fixing force can be maintained during prolonged use. Also, the durability of the connecting pin 3 can thereby be improved.

Also, since the large-diameter portion 231 is formed in the through-hole 23 and the protrusions 34 engage the large-diameter portion 231, the connecting pin 3 moves in the direction in which the protrusions 34 engage the large-diameter portion 231 and is stabilized even when the connecting pin 3 is misaligned in the axial direction in the through-hole 23 while the band 1 is in use, so the connecting pin 3 can be reliably prevented from falling out.

(4) When the proximal ends of the protrusions 34 are in contact with each other, the length L5 between the protrusions 34 is set to be slightly larger than the diameter D1 of the through-hole 23 (for example, 2/100 mm), so the connecting pin 3 can be inserted via the through-hole 23 without excessive stress being applied to the distal ends of the protrusions 34. At the same time, an appropriate urging force for the through-hole 23 can be obtained, so the connecting pin 3 can be satisfactorily and reliably fixed in the through-hole 23, and the connecting pin 3 can be reliably prevented from falling out while the band 1 is being used.

(5) Since the protrusions 34 are formed in an essentially arcuate shape, the protrusions 34 are angled at a certain degree in relation to the inner periphery of the through-hole 23, and the protrusions 34 are easily guided through the inner periphery of the through-hole 23 by the essentially arcuate sections when the connecting pin 3 is inserted via the through-hole 23. Therefore, the force needed when the connecting pin 3 is inserted via the through-hole 23 can be reduced, and the connecting pin 3 can be made even easier to operate. Also, when the connecting pin 3 is pulled out of the through-hole 23, the linear parts 32 are guided by the protrusions 34 and bent in the direction in which they draw nearer to each other because the essentially arcuate protrusions 34 are angled in relation to the large-diameter portion 231, and the connecting pin 3 can be easily pulled out.

(6) The connecting pin 3 can be easily manufactured because each section of the connecting pin 3, namely, the folded portion 31, the linear parts 32, and the protrusions 34, are formed by bending or the like from a single linear member.

Second Embodiment

Next, a second embodiment of the present invention will be described. The second embodiment differs from the first embodiment in the shape of the contact section 35.

Figure 7:
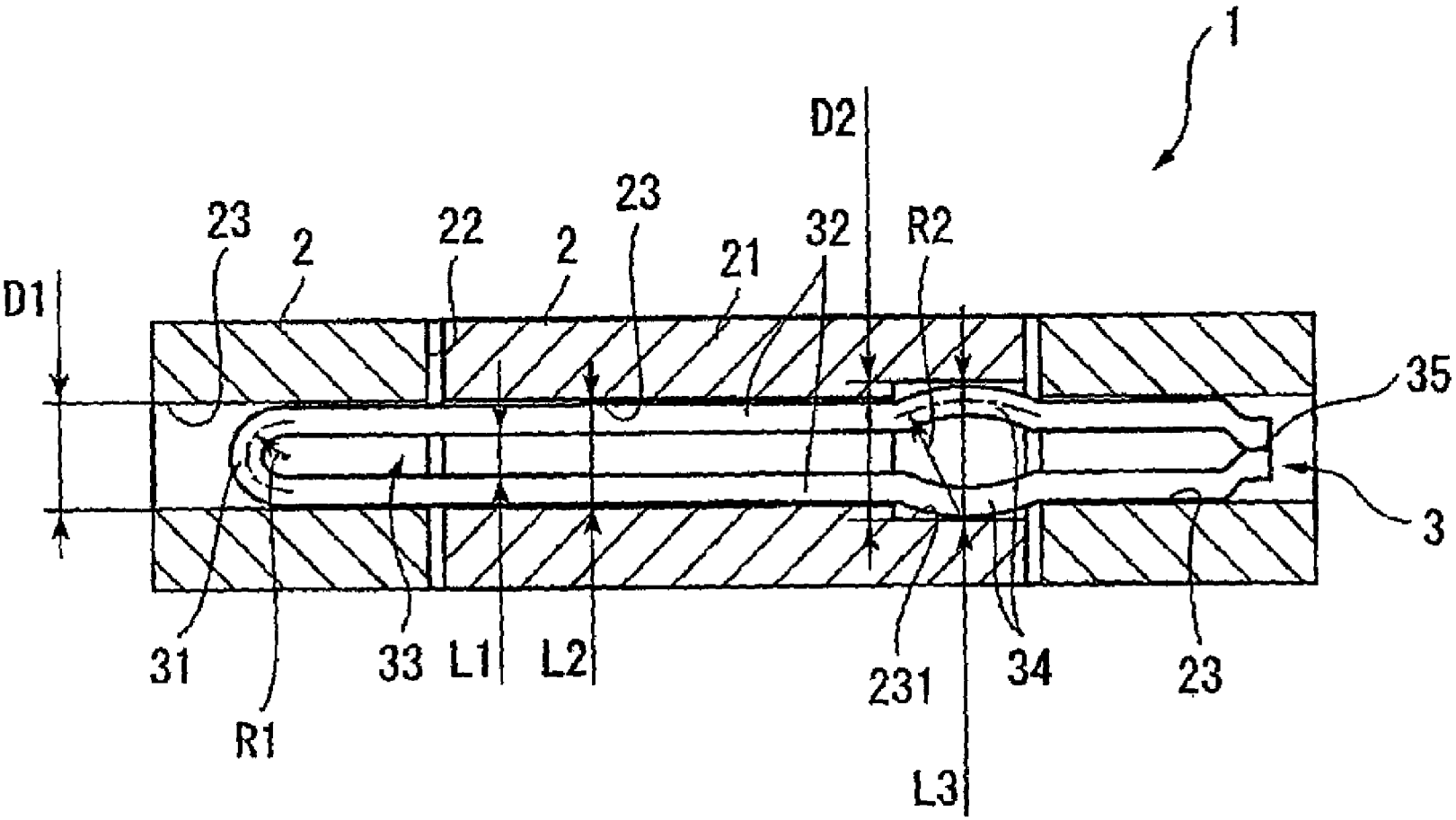
FIG. 7 is a diagram showing a block member and connector according to the second embodiment.

FIG. 7 shows a side view of a block 2 and a connecting pin 3 according to the second embodiment. The distal end side of the connecting pin 3 in FIG. 7 constitutes a contact section 35 wherein the distal ends of the linear parts 32 come into contact with each other, similar to the first embodiment. The linear parts 32 are disposed such that the lengths from the proximal ends of the protrusions 34 to the contact section 35 are virtually parallel to each other, unlike the first embodiment. The contact section 35 is slanted in the direction in which the distal ends of the linear parts 32 draw near to each other and the distal ends further out are disposed to be parallel for a specific length, whereby the distal ends are in contact over a specific surface area. The two linear parts 32 are thereby connected to each other on both sides of the protrusions 34.

According to the second embodiment, the same effects as in (1) to (6) of the first embodiment can be obtained.

Third Embodiment

Next, a third embodiment of the present invention will be described. In the third embodiment, the contact section 35 of the first embodiment is formed on both sides of the protrusions 34.

Figure 8:
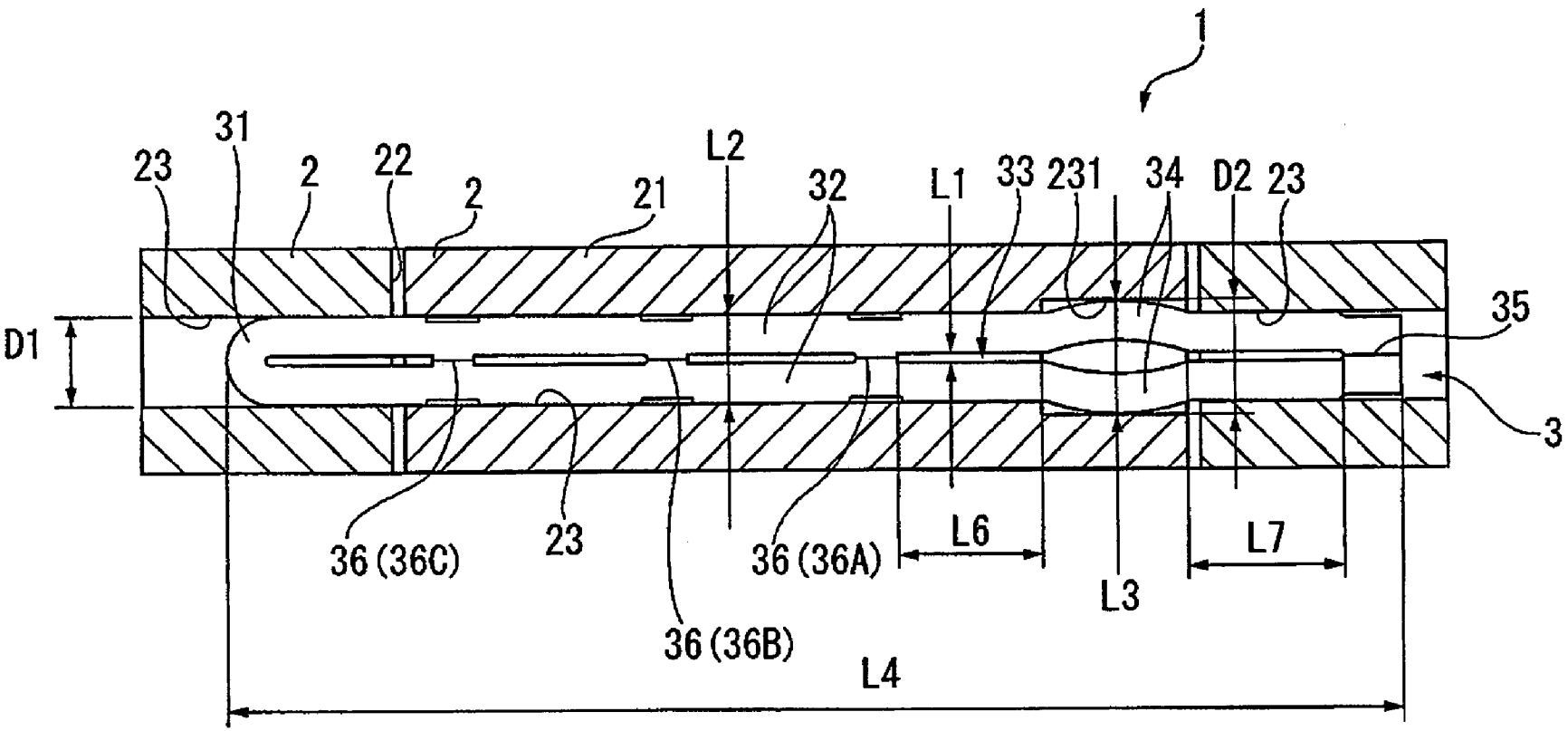
FIG. 8 is a diagram showing a block member and connector according to the third embodiment.

FIG. 8 shows a side view of a connecting pin 3 and a block 2 according to the third embodiment. In the connecting pin 3, the distal ends of the pair of linear parts 32 are connected to each other to form the contact section 35 as shown in FIG. 8, similar to the second embodiment. Also, contact sections 36 (36A, 36B, 36C) are formed at a plurality of locations (three locations in the present embodiment) between the protrusions 34 and the folded portion 31. These contact sections 36A, 36B, and 36C are disposed at substantially equal intervals between the proximal ends of the protrusions 34 and the folded portion 31. A space 33 is formed between the pair of linear parts 32 between the contact section 35 and the contact section 36A. The distance L6 from the proximal end of one protrusion 34 to the contact section 36A, and the distance L7 from the proximal end of the other protrusion 34 to the contact section 35 are set to be virtually equal. The number of contact sections 36 formed, the interval between the contact sections 36, and the like are appropriately set in view of the length of the connecting pin 3, the force needed to insert and withdraw the connecting pin 3, and the like.

When the connecting pin 3 with such a structure is inserted via the through-hole 23, the connecting pin 3 bends about the contact section 35 and the contact section 36A as two points of support, and the protrusions 34 engage the inner periphery of the through-hole 23.

According to the third embodiment, the following effects are obtained in addition to the same effects as in (1), (3), (4), (5), and (6) of the first embodiment.

(7) Since a contact section 36A is formed between the proximal ends of the protrusions 34 and the folded portion 31, the connecting pin 3 can bend about the contact section 35 and the contact section 36A as two points of support. Therefore, the stress at each point of support can be reduced similar to the effects of (2) in the first embodiment, so the connecting pin 3 is formed in a stable manner, the connecting pin 3 can satisfactorily withstand repeated deformation due to inserting and pulling out, and the durability of the connecting pin 3 can be improved. Also, the bending rigidity of the linear parts 32 can be improved due to the connecting pin 32 deforming at two points of support. Therefore, the fixing force needed for the connecting pin 3 can be easily maintained. Furthermore, since the contact section 36A is formed between the protrusions 34 and the folded portion 31, the force by which the connecting pin 3 is inserted and pulled out can be adjusted by appropriately setting the distance L6 to the proximal ends of the protrusions 34 and the contact section 36A, even when, for example, the connecting pin 3 has a considerable overall length L4. Therefore, the necessary fixing force can be reliably obtained regardless of the shape or dimensions of the block 2.

(8) Since the contact sections 36B and 36C are provided, the pair of linear parts 32 come into contact with each other at a plurality of locations, and it is possible to prevent satisfactorily the occurrence of deformation due to inserting or pulling out the connecting pin in relation to the through-hole 23, or twisting or bending that occurs when the band is worn on the wrist. The long-term durability of the connecting pin 3 can thereby be improved.

Fourth Embodiment

Next, a fourth embodiment of the present invention will be described.

Figure 9:
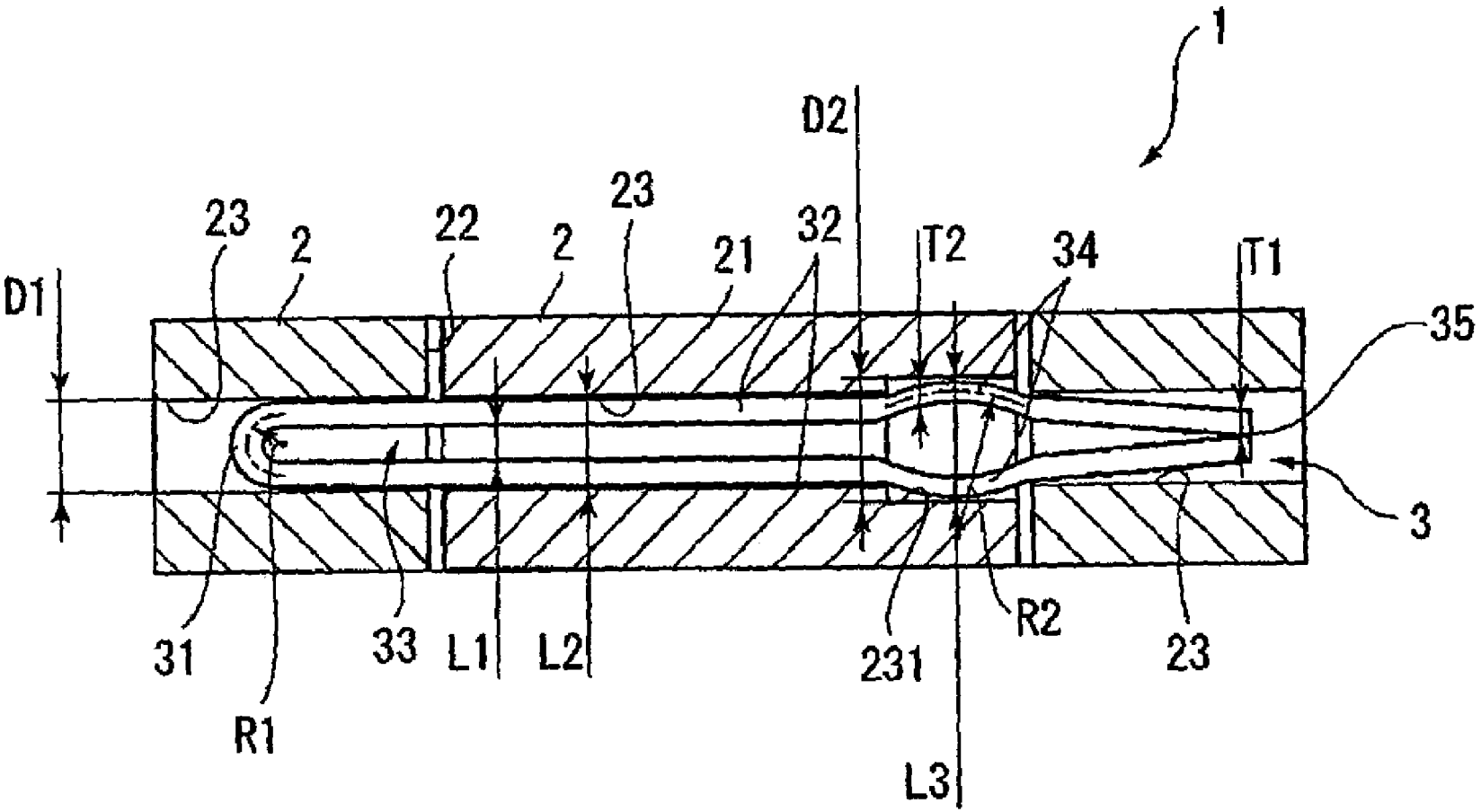
FIG. 9 is a diagram showing a block member and connector according to the fourth embodiment.

FIG. 9 shows a side view of a connecting pin 3 and a block 2 according to the fourth embodiment. In FIG. 9, the thickness T2 of the protrusions 34 is reduced to below the thickness T1 of the linear parts 32 (equivalent to the radius r1 in the first embodiment). The wording "thickness of the protrusions 34" herein denotes the dimension in the direction in which a protrusion 34 draws near to or moves away from the opposite linear part 32 (vertical direction in FIG. 9).

According to the fourth embodiment, the following effects are obtained in addition to the same effects in (1) to (6) of the first embodiment.

(9) Since the protrusions 34 are formed to be thinner than the linear parts 32, they are more apt to deform, and therefore the connecting pin 3 can be more simply inserted via the through-hole 23.

Also, the elastic force of the connecting pin 3 can be easily adjusted by adjusting the thickness of the protrusions 34.

The present invention is not limited to the previously described embodiments and includes all modifications, improvements, and the like within a range capable of achieving the objectives of the present invention.

The cross-sectional shape of the connector is not limited to a semicircle, and a full circle, rectangle, or another such arbitrary shape can be employed. Also, the cross-sectional shape of the through-hole is not limited to a circle, and can be appropriately set according to the cross-sectional shape of the connector.

The connector was formed into a substantial U shape by folding linear members, but is not limited thereto and may, for example, be formed into a ring shape in which the connector is continuously connected. In this case, the connector can be deformed about two folded parts as points of support by forming, for example, the two folded parts and linear parts that connector these folded parts. Alternatively, the connector may be formed into a substantially angular U shape by bending the linear members. In other words, the connector should have the pair of linear parts disposed virtually parallel with a specific distance in between, and should be connected in at least one end.

The large-diameter portion of the through-hole is not limited to being formed around the entire inner periphery of the through-hole, and may, for example, be formed around part of the inner periphery of the through-hole. In this case, the connector should be inserted while aligning the positions of the protrusions with the large-diameter portion.

The protrusions were provided to each of a pair of linear parts, but are not limited to this arrangement and may be formed, for example, either one of the linear parts. Also, the position at which the protrusions are formed is not limited to the distal end side of the linear parts and can be arbitrarily set according to the position of the large-diameter portion in the through-hole, the range of the elastic area of the linear parts, or the like. When the protrusions are formed on both of the pair of linear parts, the pair of protrusions may both be disposed at the same positions in the lengthwise direction of the linear parts as in the embodiments previously described, or they may be disposed at different positions in the lengthwise direction of the linear parts. Furthermore, the shape of the protrusions is not limited to an essentially arcuate shape, and a substantially triangular, rectangular, or other such arbitrary shape that protrudes directly outward in the axial direction can be employed.

Figure 10:
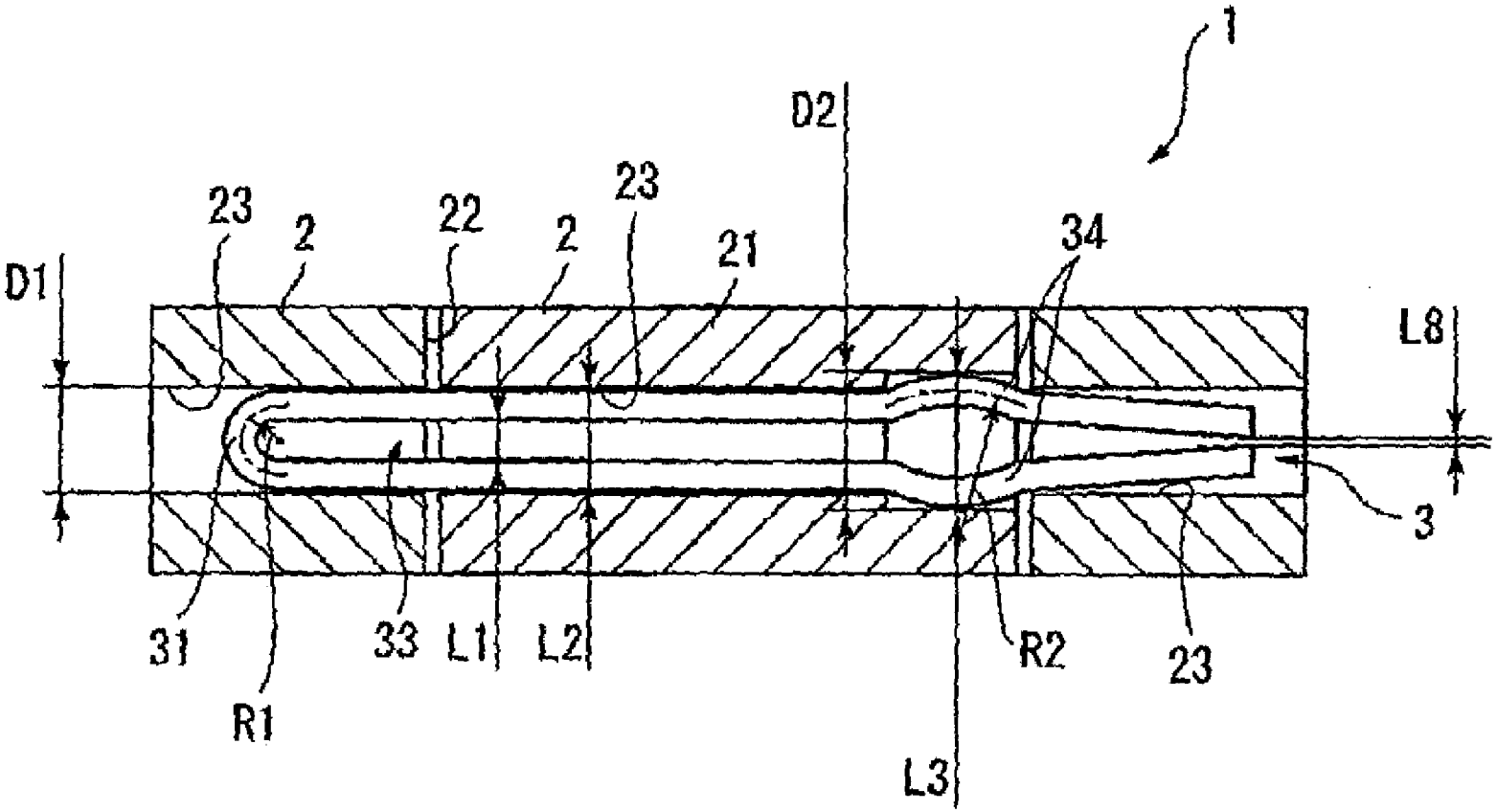
FIG. 10 is a diagram showing a modification of the connector of the first embodiment.

In each embodiment, the contact section 35 was formed by bringing the distal end sides of the linear parts into contact with each other, but the arrangement is not limited thereto, and a specific distance L8 may be left between the distal ends of the linear parts 32 as shown in FIG. 10, for example. In FIG. 10, the linear parts 32 farther down toward the distal ends than the ends of the protrusions 34 are slanted in the direction in which they draw near to each other as in the first embodiment, but the distal ends are disposed with a specific distance L8 in between. The specific distance L1 referred to herein is set to be larger than the specific distance L8. In this case, when the protrusions 34 are pressed on by the through-hole 23 and the linear parts 32 bend, the distal ends of the linear parts 32 come into contact before the proximal ends of the protrusions 34 come into contact with each other, and the connector subsequently deforms in the same manner as in the first embodiment about the folded portion 31 and the contact section of the distal ends as two points of support. With such a configuration, the timing with which an elastic force is produced in the linear parts 32 can be adjusted by adjusting the specific distance L8, and the urging force relating to the protrusions 34 can be flexibly adjusted. In other words, the shape of the linear parts should be such that the connector comes in contact at the two points on both sides of the protrusions before the proximal ends of the protrusions come in contact with the opposite linear part.

Figure 11:
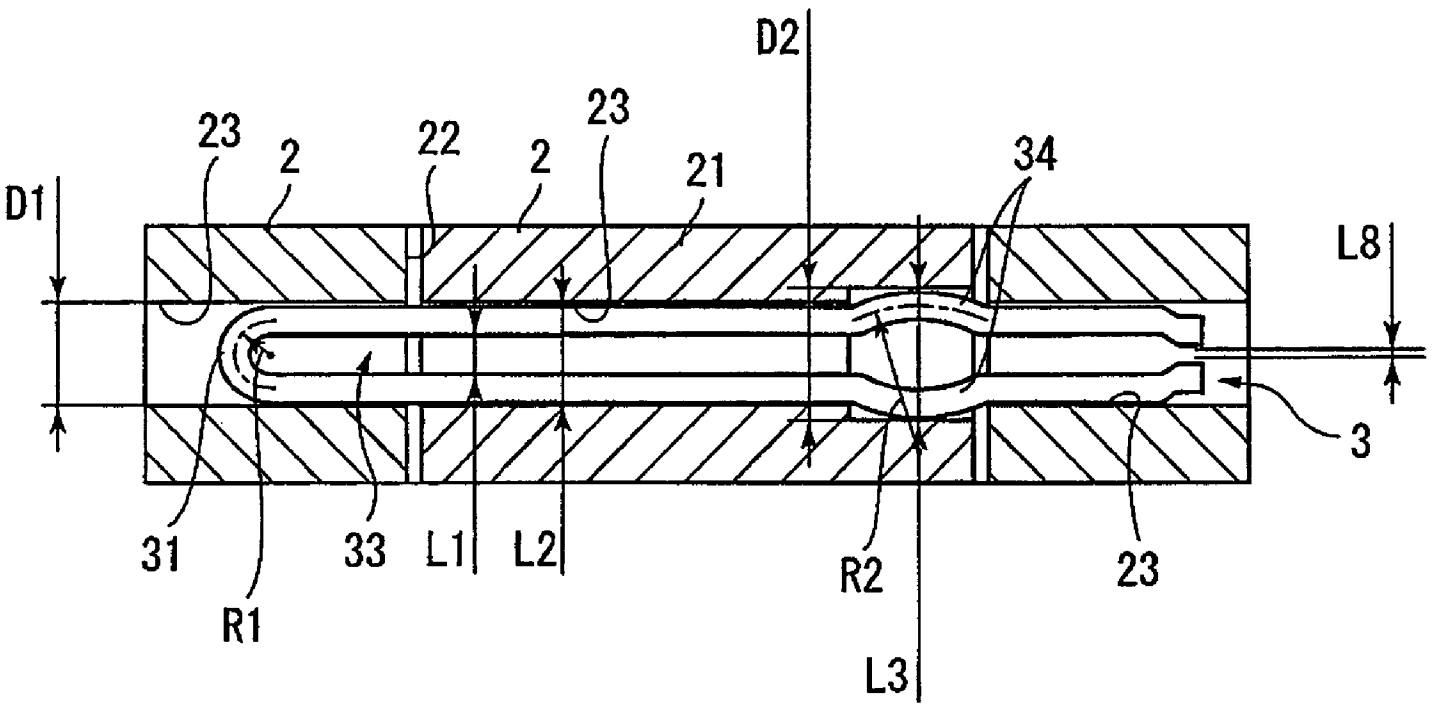
FIG. 11 is a diagram showing a modification of the connector of the second embodiment.

Also, the distal ends of the connecting pin 3 in the second embodiment may be disposed with a specific distance L8 in between, as shown in FIG. 11. In this case, the timing with which the elastic force is produced in the linear parts 32 can be adjusted by adjusting the specific distance L8, similar to the previously described cases.

Figure 12:
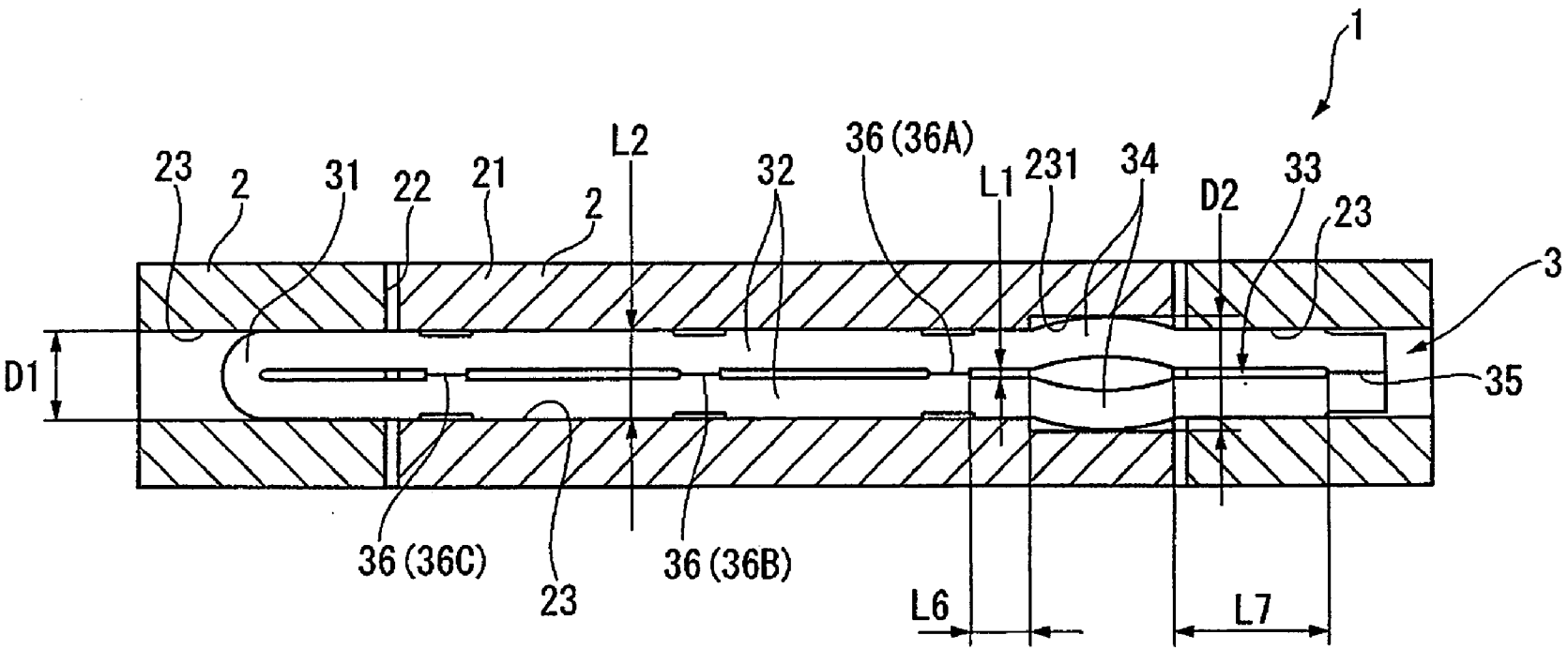
FIG. 12 is a diagram showing a modification of the connector of the third embodiment.

In the third embodiment, the distance L6 from the proximal ends of the protrusions 34 to the contact section 36A, and the distance L7 from the proximal ends of the protrusions 34 to the contact section 35 are set to be virtually the same, but this arrangement is not limited thereto and the distance L6 may be set to be shorter than the distance L7, as shown in FIG. 12, for example. In this case, the portion of the linear parts 32 from the proximal ends of the protrusions 34 to the contact section 35 is more apt to bend than the portion of the linear parts 32 from the proximal ends of the protrusions 34 to the contact section 36A, so the pressing force of the connecting pin 3 when inserted via the through-hole 23 can be less than the pulling force when the connecting pin 3 is pulled out of the through-hole 23. Therefore, the connecting pin 3 can be designed to be pushed in with ease and less likely to fall out. Thus, the insertion and withdrawal force and the fixing force of the connecting pin 3 can be arbitrarily adjusted by appropriately setting the distance L6 and the distance L7.

The distance L6 may also be set to be longer than the distance L7.

Figure 13:
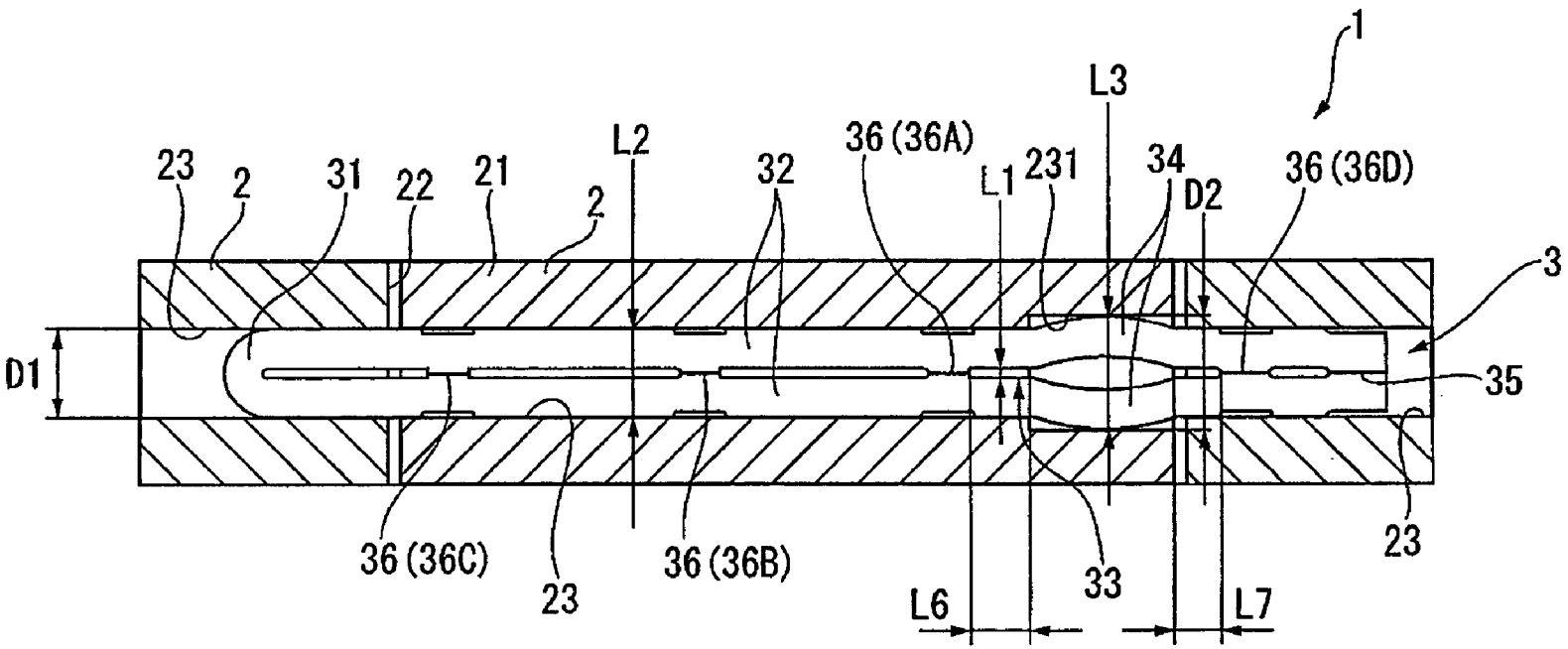
FIG. 13 is a diagram showing another modification of the connector of the third embodiment.

The contact sections are not limited to being formed between the distal ends of the linear parts and between the proximal ends of the protrusions and the folded portions, and a contact section 36D may also be formed between the proximal ends of the protrusions 34 and the contact section 35 at the distal ends of the linear parts 32, as shown in FIG. 13, for example. The desired insertion and withdrawal force (fixing force) can be maintained in this case as well by appropriately setting the distance L7 from the proximal ends of the protrusions 34 to the contact section 36D.

Figure 14:
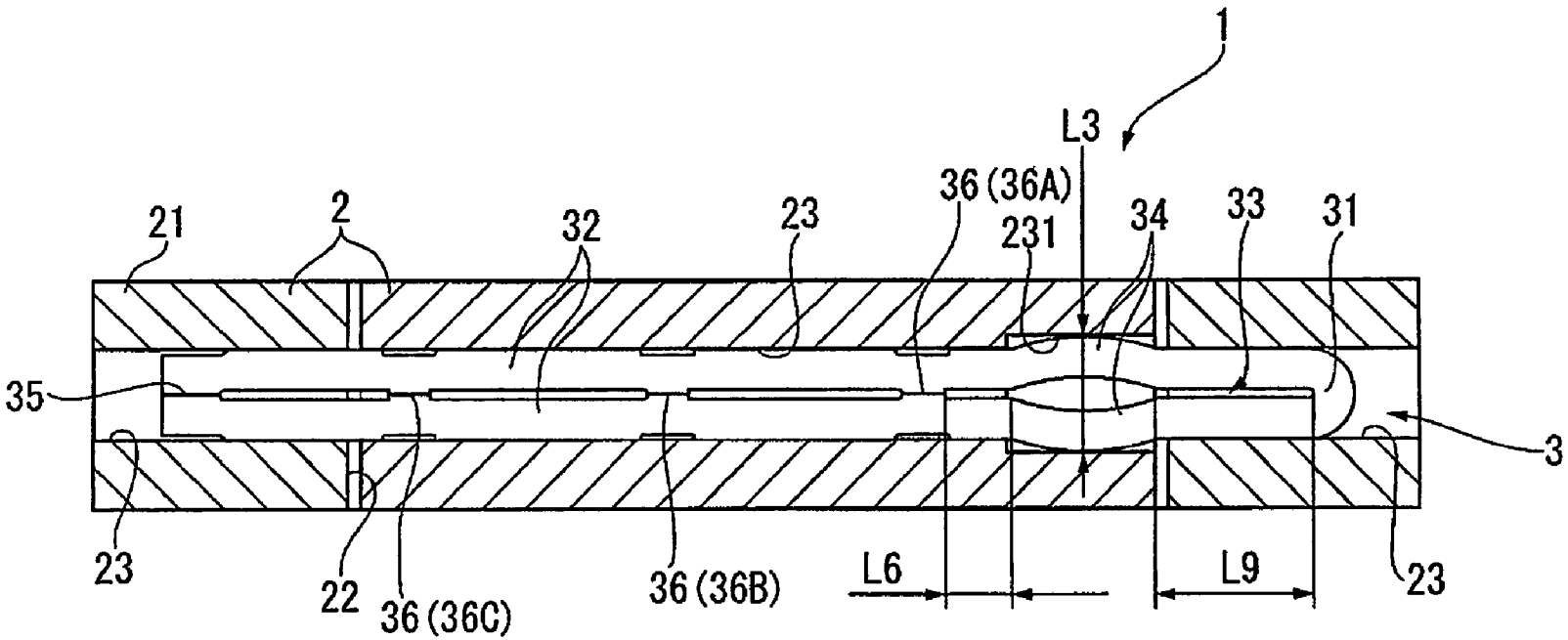
FIG. 14 is a diagram showing yet another modification of the connector of the third embodiment.

The protrusions 34 are not limited to being formed on the side near the distal ends of the linear parts, and may be formed at positions near the folded portion 31, as shown in FIG. 14, for example. In this case, the entire length of the connecting pin 3 can be simply adjusted by adjusting the length of the distal end sides of the linear parts 32. It is thereby possible to manufacture common connecting pins 3 having various lengths, making it possible to use common components and the costs of manufacturing the connecting pins 3 to be reduced.

Also, in this case, contact sections 36 (36A, 36B, 36C) at a plurality of locations (three locations in FIG. 14) may be formed between the proximal ends of the protrusions 34 and the contact section 35 at the distal ends of the linear parts 32. In this case, the insertion and withdrawal force of the connecting pin 3 can be appropriately adjusted by appropriately setting the distance L6 from the proximal ends of the protrusions 34 to the contact section 36A, and the distance L9 from the proximal ends of the protrusions 34 to the folded portion 31.

The shape of the block member is not limited to one provided with a convexity and a concavity, and can be arbitrarily set with consideration to its function or design.

The connector of the present invention is not limited to the band of a timepiece, and can be applied, for example, to a bracelet, a necklace, or any other such band, component, or product in which a plurality of block members must be connected. In these cases as well, the connector is inserted via a through-hole while elastic deformation is suppressed to a minimum, so a stable fixing force can be obtained over a long period of time even when the connector is repeatedly inserted and withdrawn to adjust the length or to replace the block member.

The preferred configurations, methods, and other aspects employed in order to carry out the present invention are disclosed in the above descriptions, but the present invention is not limited thereto. Specifically, the present invention is particularly illustrated and described primarily with reference to specific embodiments, but those skilled in the art can make various modifications to the shapes, materials, quantities, and other specific details of the embodiments described above without deviating from the scope of the technical ideas and objects of the present invention.

Therefore, the descriptions that are disclosed above and refer to specific shapes, materials, and other aspects are given solely with the intent of making the present invention easy to understand and are not intended to limit the present invention. For this reason, descriptions that contain names of members in which some or all of the limitations on shapes, materials, and other items have been removed are also included in the present invention.

WORKING EXAMPLES

The following experiments were conducted to confirm the effects of the present invention.

Working Example 1

An experiment was conducted using the connecting pin 3 of the third embodiment (FIG. 8).

The distance L6 from the proximal ends of the protrusions 34 in the connecting pin 3 to the contact section 36A was 2.0 mm, and the distance L7 from the proximal ends of the protrusions 34 to the contact section 35 was 2.0 mm. Also, the distance L1 between the pair of linear parts 32 was 0.1 mm, and the entire length L4 of the connecting pin 3 was 14 mm. Furthermore, the difference between the distance L3 between the protrusions 34 and the diameter D1 of the inner periphery of the through-hole 23 was set to 0.1 mm.

The connecting pin 3 was repeatedly (seven times) inserted into and withdrawn from the through-hole 23, and the pulling force thereof was measured.

Working Example 2

An experiment was conducted using the connecting pin 3 shown in FIG. 13.

The distance L6 from the proximal ends of the protrusions 34 in the connecting pin 3 to the contact section 36A was 1.0 mm, and the distance L7 from the proximal ends of the protrusions 34 to the contact section 36D was 1.0 mm. Also, the difference between the distance L3 between the protrusions 34 and the diameter D1 of the inner periphery of the through-hole 23 was set to 0.08 mm. The conditions were otherwise the same as in Working Example 1.

Working Example 3

An experiment was conducted using the connecting pin 3 in FIG. 12.

The distance L6 from the proximal ends of the protrusions 34 in the connecting pin 3 to the contact section 36A was 1.0 mm, and the distance L7 from the proximal ends of the protrusions 34 to the contact section 35 was 2.0 mm. The conditions were otherwise the same as in Working Example 1.

Comparative Example 1

Figure 15:
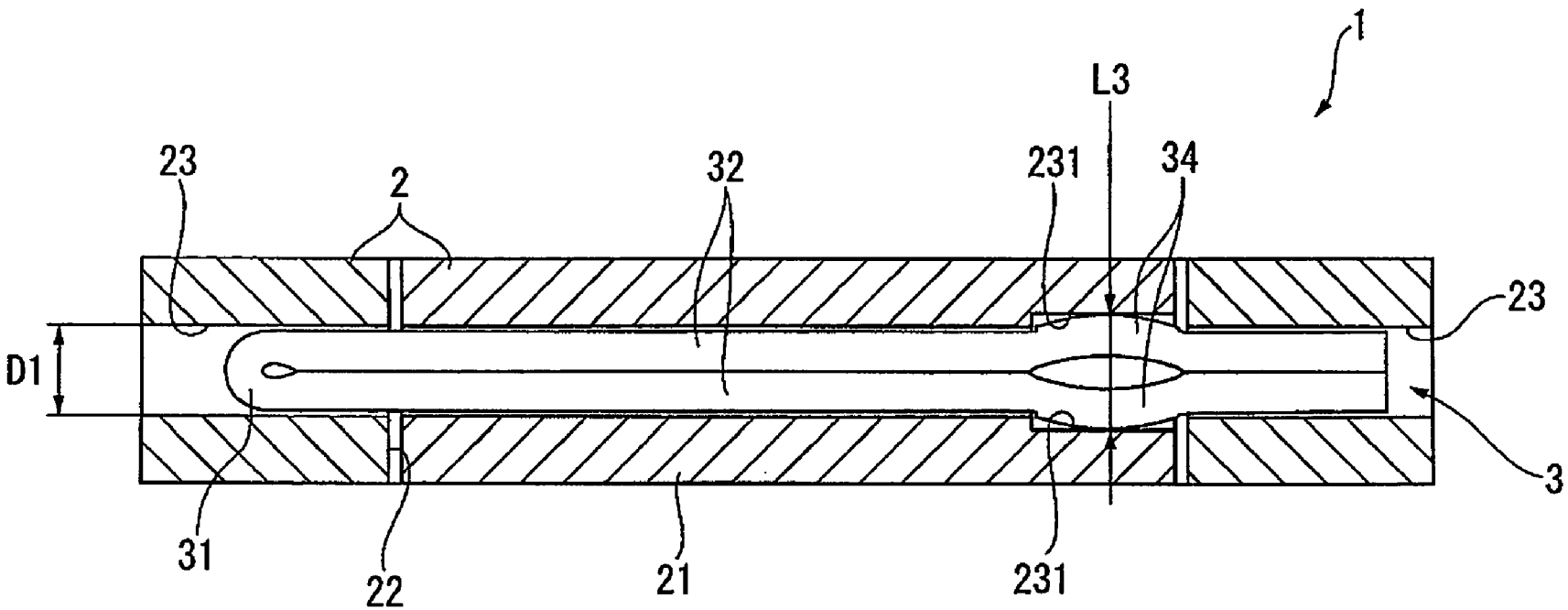
FIG. 15 is a diagram showing a connector of a comparative example.

An experiment was conducted using the connecting pin 3 with a conventional structure shown in FIG. 15.

In the connecting pin 3 in FIG. 15, two linear parts 32 were in contact with each other across nearly the entire length, and no space was formed therebetween. The difference between the distance L3 from one protrusion 34 to the other and the diameter D1 of the inner periphery of the through-hole 23 was set to 0.1 mm. The conditions were otherwise the same as in Working Example 1.

Results of Working Examples 1 Through 3 and Comparative Example 1

Figure 16:
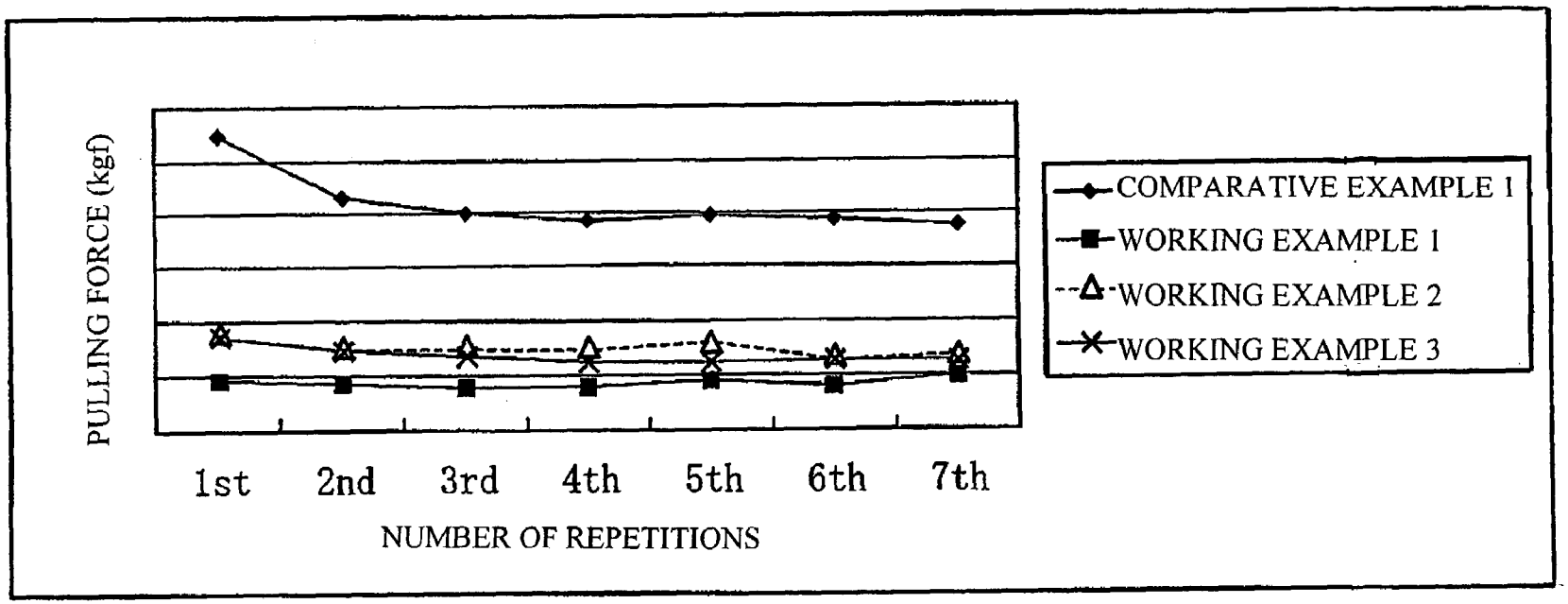
FIG. 16 is a diagram showing the experimental results of Working Examples 1, 2, and 3 and Comparative Example 1.

The results are shown in FIG. 16. It is clear that in Comparative Example 1, the pulling force of the connecting pin 3 decreases with an increase in the number of times the connecting pin 3 is inserted and withdrawn, as shown in FIG. 16. It is also apparent that in Working Examples 1 through 3 the decrease in pulling force is small and the pulling force remains stable even when the connecting pin 3 is repeatedly inserted and withdrawn.

Working Example 4

An experiment was conducted using the connecting pin 3 shown in FIG. 8.

The difference between the distance L3 from one protrusion 34 to the other and the diameter D1 of the inner periphery of the through-hole 23 was set to 0.21 mm. The conditions were otherwise the same as in Working Example 1.

Working Example 5

An experiment was conducted using the connecting pin 3 shown in FIG. 8.

The difference between the distance L3 from one protrusion 34 to the other and the diameter D1 of the inner periphery of the through-hole 23 was set to 0.15 mm. The conditions were otherwise the same as in Working Example 1.

Comparative Example 2

An experiment was conducted using the connecting pin 3 shown in FIG. 15.

The difference between the distance L3 from one protrusion 34 to the other and the diameter D1 of the inner periphery of the through-hole 23 was set to 0.05 mm. The conditions were otherwise the same as in Working Example 1.

Results of Working Examples 1, 4, and 5, and Comparative Examples 1 and 2

Figure 17:
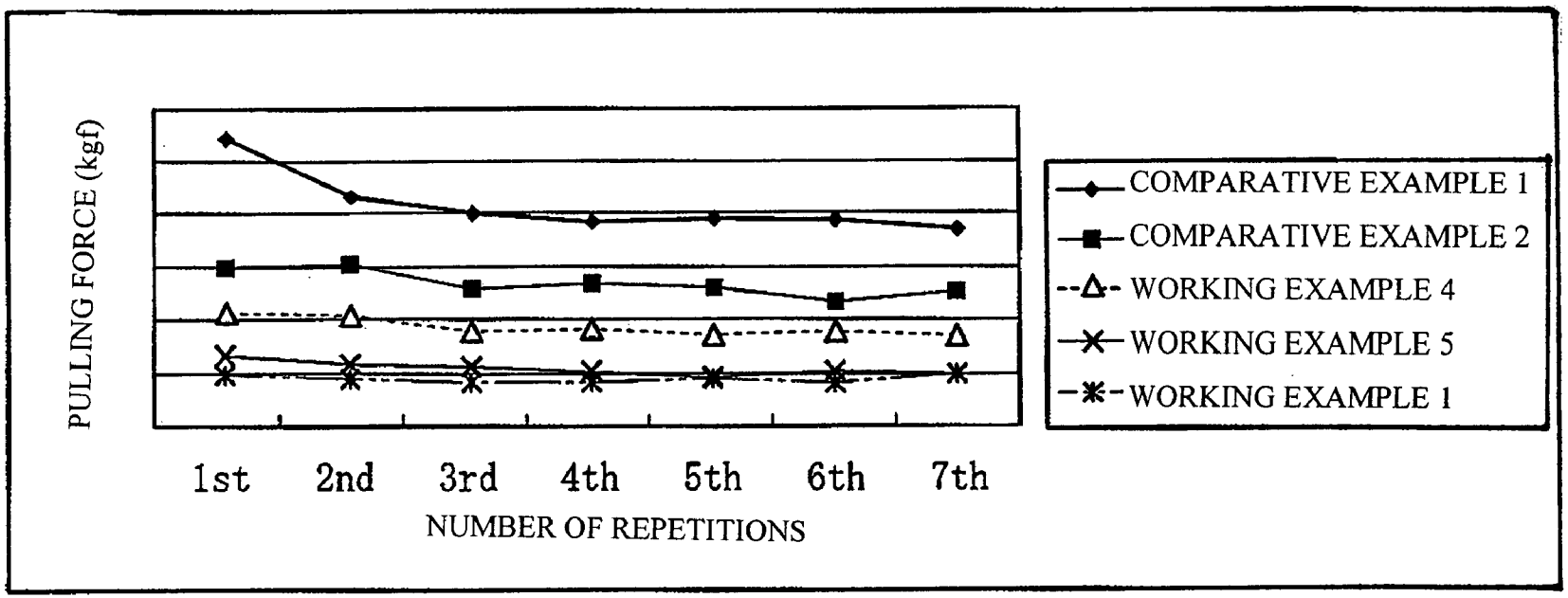
FIG. 17 is a diagram showing the experimental results of Working Examples 1, 4, and 5 and Comparative Examples 1 and 2.

The results are shown in FIG. 17. It is clear that in Comparative Examples 1 and 2, the pulling force of the connecting pin 3 decreases with an increase in the number of times the connecting pin 3 is inserted and withdrawn, as shown in FIG. 17. It is also apparent that in Working Examples 1, 4, and 5 a stable pulling force is obtained even when the connecting pin 3 is repeatedly inserted and withdrawn.

Also, it is clear that in Working Examples 4 and 5 the pulling force does not increase excessively and is still less than the pulling force in Comparative Example 2 even when the difference between the distance L3 from one protrusion 34 to the other and the diameter D1 of the inner periphery of the through-hole 23 is greater than in Comparative Example 1. Thus, since the pulling force can be appropriately set even when the distance L3 between the protrusions 34 is set to be large, the variations in pulling force due to dimensional errors in the distance L3 between the protrusions 34 or the diameter D1 of the inner periphery of the through-hole 23 in the manufacturing process have very little effect, and a connecting pin 3 with a stable pulling force can be manufactured. Also, since the variations in pulling force due to dimensional errors have very little effect, the manufacturing steps do not require strict monitoring of dimensions and the can be simplified.

Working Example 6

An experiment was conducted using the connecting pin 3 shown in FIG. 13.

The difference between the distance L3 from one protrusion 34 to the other and the diameter D1 of the inner periphery of the through-hole 23 was set to 0.19 mm. The conditions ware otherwise the same as in Working Example 2.

Working Example 7

An experiment was conducted using the connecting pin 3 shown in FIG. 13.

The difference between the distance L3 from one protrusion 34 to the other and the diameter D1 of the inner periphery of the through-hole 23 was set to 0.13 mm. The conditions were otherwise the same as in Working Example 2.

Results of Working Examples 2, 6, and 7, and Comparative Examples 1 and 2

Figure 18:
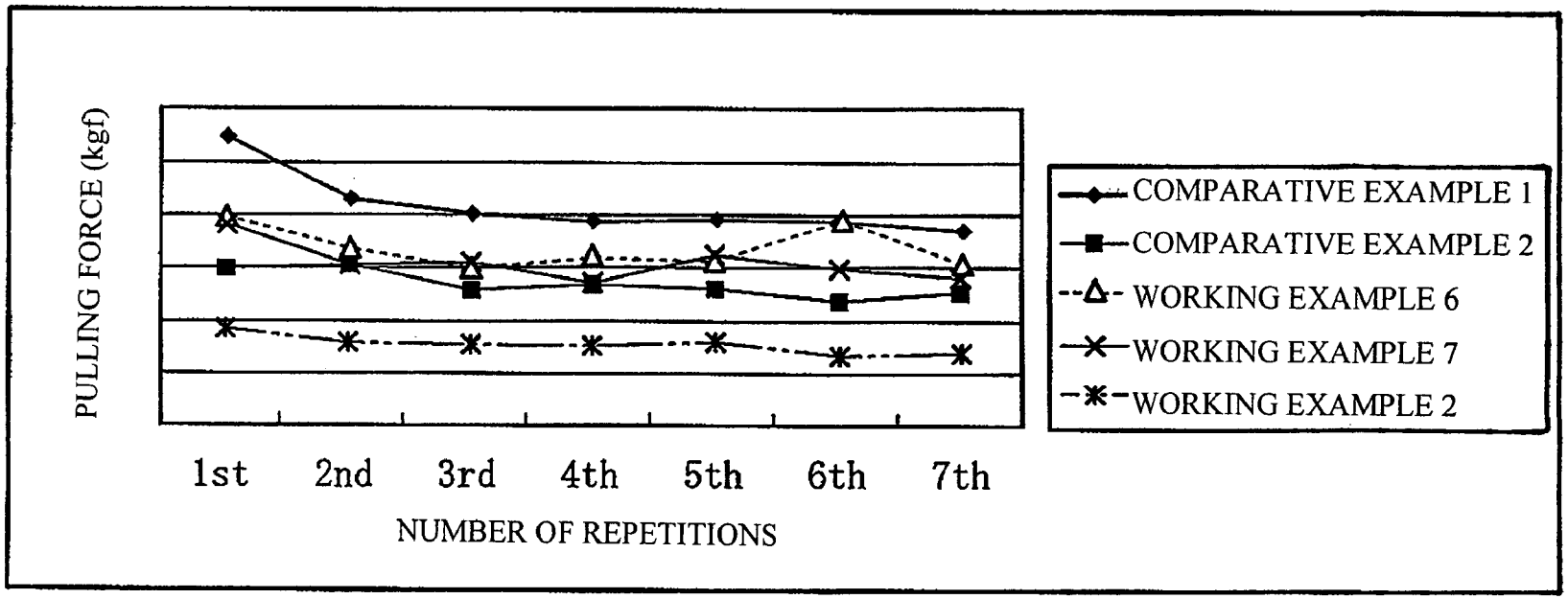
FIG. 18 is a diagram showing the experimental results of Working Examples 2, 6, and 7 and Comparative Examples 1 and 2.

The results are shown in FIG. 18. It is clear that in Comparative Examples 1, the pulling force of the connecting pin 3 decreases with an increase in the number of times the connecting pin 3 is inserted and withdrawn, as shown in FIG. 18. It is also apparent that in Working Examples 2, 6, and 7 a stable pulling force is obtained even when the connecting pin 3 is repeatedly inserted and withdrawn.

Also, it is clear that in Working Examples 2, 6, and 7 the pulling force does not increase excessively even when the difference between the distance L3 from one protrusion 34 to the other and the diameter D1 of the inner periphery of the through-hole 23 is greater than in Comparative Examples 1 and 2. Thus, since the pulling force can be appropriately set even when the distance L3 between the protrusions 34 is set to be large, the variations in pulling force due to dimensional errors in the distance L3 between the protrusions 34 or the diameter D1 of the inner periphery of the through-hole 23 in the manufacturing process have very little effect, and a connecting pin 3 with a stable pulling force can be manufactured. Also, since the variations in pulling force due to dimensional errors have very little effect, the manufacturing steps do not require strict monitoring of dimensions and can be simplified.

Working Example 8

An experiment was conducted using the connecting pin 3 shown in FIG. 12.

The difference between the distance L3 from one protrusion 34 to the other and the diameter D1 of the inner periphery of the through-hole 23 was set to 0.21 mm. The conditions were otherwise the same as in Working Example 3.

Working Example 9

An experiment was conducted using the connecting pin 3 shown in FIG. 12.

The difference between the distance L3 from one protrusion 34 to the other and the diameter D1 of the inner periphery of the through-hole 23 was set to 0.15 mm. The conditions were otherwise the same as in Working Example 2.

Results of Working Examples 3, 8, and 9, and Comparative Examples 1 and 2

Figure 19:
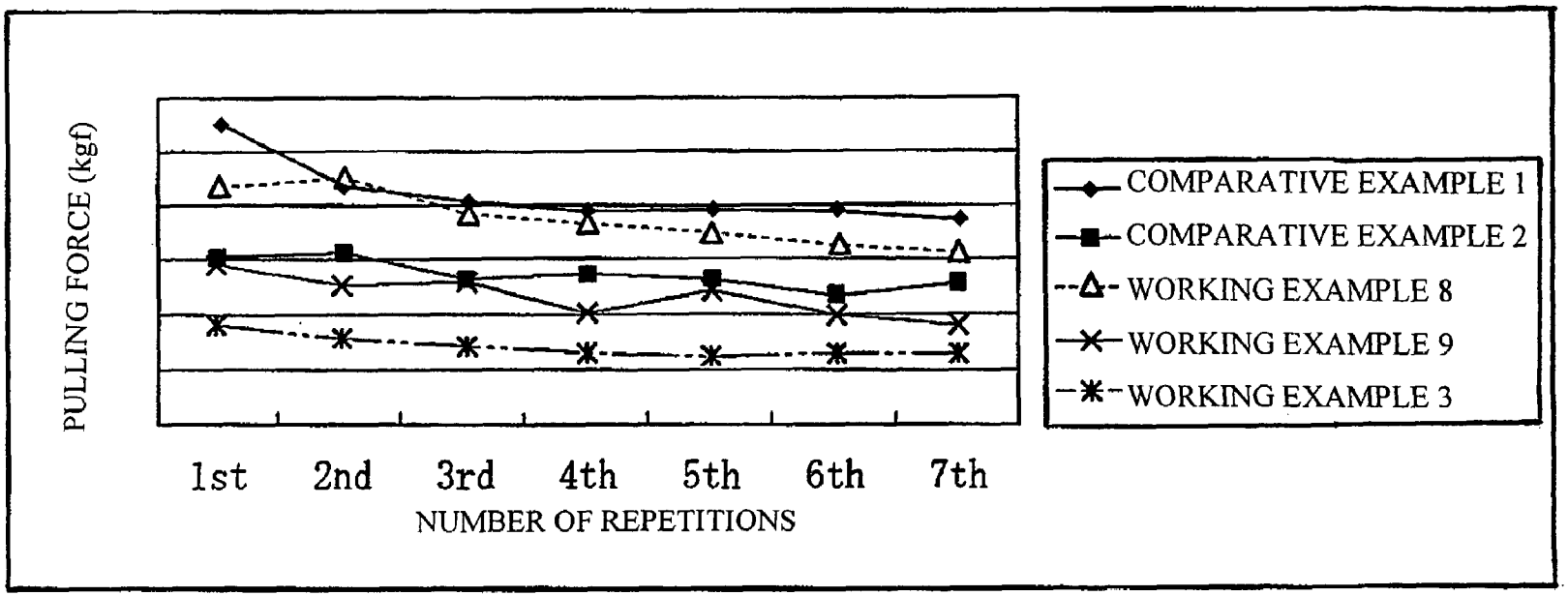
FIG. 19 is a diagram showing the experimental results of Working Examples 3, 8, and 9 and Comparative Examples 1 and 2.

The results are shown in FIG. 19. It is clear that in Comparative Example 1, the pulling force of the connecting pin 3 is reduced by repeatedly inserting and withdrawing the connecting pin 3 as shown in FIG. 19, but the decrease in pulling force is small in Working Examples 3, 8, and 9. It is also clear that in Working Examples 3, 8, and 9, in which the difference between the distance L3 from one protrusion 34 to the other and the diameter D1 of the inner periphery of the through-hole 23 is larger than with the connecting pin 3 in Comparative Example 2, a pulling force that is equal to or smaller than the pulling force in Comparative Example 2 is obtained. Thus, it is clear that the pulling force is not excessive and satisfactory operability is obtained even when the difference between the distance L3 from one protrusion 34 to the other and the diameter D1 of the inner periphery of the through-hole 23 is increased.

As described above, it was possible to confirm the effects of the present invention in that a stable pulling force and fixing force were obtained even when the connector was repeatedly used.

The terms "front," "back, "up," "down," "perpendicular," "horizontal," "slanted," and other direction-related terms used above indicate the directions in the diagrams used. Therefore, the direction-related terminology used to describe the present invention should be interpreted in relative terms as applied to the diagrams used.

"Substantially," "essentially," "about," and other terms that are used above and represent an approximation indicate a reasonable amount of deviation that does not bring about a considerable change as a result. Terms that represent these approximations should be interpreted so as to include a minimum error of about±5%, as long as there is no considerable change due to the deviation.

The disclosure in Japanese Patent Application No. 2003-097495 is incorporated herein in its entirety by reference.

The embodiments described above are only some of possible embodiments of the present invention, but it is apparent to those skilled in the art that it is possible to add modifications to the above-described embodiments by using the above-described disclosure without exceeding the range of the present invention as defined in the claims. The above-described embodiments furthermore do not limit the range of the present invention, which is defined by the accompanying claims or equivalents thereof, and are designed solely to provide a description of the present invention.

INDUSTRIAL APPLICABILITY

The connector of the present invention can be used to for connecting block members in the band of a timepiece, and can also be used for connecting the members in bracelets, necklaces, and other such personal accessories.

What is claimed is:

1. A band comprising:

a first block having a concavity and a first and second through-hole disposed in either side of said concavity;

a second block having a convexity interlocking with said concavity and having a third through-hole; and a connector being inserted through said first, second, and third through-holes and having a first linear part, a second linear part, and a folded portion connecting said first and second linear parts, said first linear part having a first rectilinear part extending from said folded portion and separated from said second linear part in a free state, a first protrusion extending from said first rectilinear part protruding away from said second linear part, and a first end -extending from a proximal end of said first protrusion away from said folded portion, and said first end having a first tip disposed such that the distance thereof to the second linear part is shorter than the distance to the second linear part from the proximal end of the first protrusion in a free state.

2. The band according to claim 1, wherein said first protrusion is formed into an essentially arcuate shape.

3. The band according to claim 1, wherein said first protrusion is disposed nearer to said tip side than a middle of said first linear part.

4. The band according to claim 1, wherein said second block has a large-diameter portion to accommodate said first protrusion, disposed between said second through-hole and said third through-hole.

5. The band according to claim 4, wherein said large-diameter portion has an inside diameter that is greater than a total thickness of said connector in said first protrusion in a free state.

6. The band according to claim 4, wherein inside diameters of said first through-hole, said second through-hole, and said third through-hole are smaller than a total thickness of said connector in said first protrusion in a free state.

7. The band according to claim 1, wherein said second linear part has a second rectilinear part extending from said folded portion and separated from said first linear part in a free state, a second protrusion that extends from said second rectilinear part and that protrudes away from said first linear part, and a second end that extends from a proximal end of said second protrusion away from said folded portion.

8. The band according to claim 7, wherein said second end has a second tip disposed such that a distance thereof to said first linear part is shorter than a distance to said first linear part from said proximal end of said second protrusion in a free state.

9. The band according to claim 7, wherein said second protrusion is disposed at a location corresponding to said first protrusion.

10. The band according to claim 7, wherein said first and second protrusions are formed in an essentially arcuate shape.

11. The band according to claim 7, wherein said first and second protrusions are formed nearer to said first tip side than a middle of said first and second linear parts.

12. The band according to claim 7, wherein said second block has a large-diameter portion to accommodate said first and second protrusions, disposed between said second through-hole and said third through-hole.

13. The band according to claim 12, wherein said large-diameter portion has an inside diameter that is greater than a total thickness of said connector in said first and second protrusions in a free state.

14. The band according to claim 13, wherein inside diameters of said first through-hole, said second through-hole, and said third through-hole are smaller than a total thickness of said connector in said first and second protrusions in a free state.

15. The band according to claim 1, wherein said connector is a semicircle in cross section and is configured from a linear metal member.

16. The band according to claim 1, wherein said first linear part is disposed a specific distance away from said proximal end of the first protrusion and has a first contact section that protrudes towards said second linear part.

17. The band according to claim 16, wherein said second linear part has a second contact section that protrudes towards said first contact section in a position corresponding to the first contact section.

18. A band comprising:

a first block having a concavity and a first and second through-hole disposed in either side of said concavity;

a second block having a convexity interlocking with said concavity and having a third through-hole; and a connector being inserted through said first, second, and third through-holes and having a first linear part, a second linear part, and a folded portion connecting said first and second linear parts, said first linear part having a first rectilinear part extending from said folded portion and separated from said second linear part in a free state, a first protrusion extending from said first rectilinear part and protruding away from said second linear part, and a first end extending from a proximal end of said first protrusion away from said folded portion, said first end has a first tip disposed such that the distance thereof to said second linear part is shorter than the distance to said second linear part from said proximal end of said first protrusion in a free state, said second linear part having a second rectilinear part extending from said folded portion and separated from said first linear part in a free state, a second protrusion extending from said second rectilinear part and protruding away from said first linear part, and a second end extending from a proximal end of said second protrusion away from said folded portion, said second end having a second tip disposed such that the distance thereof to said first linear part is shorter than the distance to said first linear part from said proximal end of said second protrusion in a free state, said second protrusion being disposed at a location corresponding to said first protrusion, said first and second protrusions being formed in an essentially arcuate shape, and said first and second protrusions being formed nearer to a side of said first and second tips than a middle of said first and second linear parts, said second block having a large-diameter portion to accommodate said first and second protrusions, disposed between said second through-hole and said third through-hole, said large-diameter portion having an inside diameter greater than a total thickness of said connector in said first and second protrusions in a free state, inside diameters of said first through-hole, said second through-hole, and said third through-hole being smaller than said total thickness of said connector in said first and second protrusions in a free state, and said connector being a semicircle in cross section and configured from a linear metal member.

19. A connector comprising:

a first linear part;

a second linear part; and a folded portion connecting said first and second linear parts, said first linear part having a first rectilinear part extending from said folded portion and separated from said second linear part in a free state, a first protrusion extending from said first rectilinear part and protruding away from said second linear part, and a first end extending from a proximal end of said first protrusion away from said folded portion, said first end having a first tip disposed such that the distance thereof to said second linear part is shorter than the distance to said second linear part from a proximal end of said first protrusion in a free state.

20. The connector according to claim 19, wherein said second linear part has a second rectilinear part extending from said folded portion and separated from said first linear part in a free state, a second protrusion extending from said second rectilinear part and protruding away from said first linear part, and a second end extending from a proximal end of said second protrusion away from said folded portion.

21. The connector according to claim 20, wherein said second end has a second tip disposed such that the distance thereof to said first linear part is shorter than the distance to said first linear part from said proximal end of said second protrusion in a free state.

22. The connector according to claim 21, wherein said second protrusion is disposed at a location corresponding to said first protrusion.

23. A timepiece comprising:

a timepiece main body; and a band connected to said timepiece main body comprising, a first block having a concavity and a first and second through-hole disposed in either side of said concavity, a second block having a convexity interlocking with said concavity and having a third through-hole, and a connector being inserted through said first, second, and third through-holes and having a first linear part, a second linear part, and a folded portion connecting said first and second linear parts, said first linear part having a first rectilinear part extending from said folded portion and separated from said second linear part in a free state, a first protrusion extending from said first rectilinear part and protruding away from said second linear part, and a first end extending from a proximal end of said first protrusion away from said folded portion, said first end having a first tip disposed such that the distance thereof to said second linear part is shorter than the distance to said second linear part from said proximal end of said first protrusion in a free state.

24. A band comprising:

first block means;

second block means; and connecting means for connecting said first block means and second block means, having a first linear part, a second linear part, and a folded portion connecting said first and second linear parts, said first linear part having a first rectilinear part extending from said folded portion and separated from said second linear part in a free state, a first protrusion extending from said first rectilinear part and protruding away from said second linear part, and a first end extending from a proximal end of said first protrusion away from said folded portion, said first end having a first tip disposed such that the distance thereof to said second linear part is shorter than the distance to said second linear part from said proximal end of said first protrusion in a free state.

* * * * *